US007749073B2

(12) United States Patent
Thomas et al.

(10) Patent No.: US 7,749,073 B2
(45) Date of Patent: Jul. 6, 2010

(54) WAGERING GAME WITH ENHANCED PAYLINE FEATURE

(75) Inventors: Alfred Thomas, Las Vegas, NV (US); Dion K. Aoki, Henderson, NV (US)

(73) Assignee: WMS Gaming Inc., Waukegan, IL (US)

( * ) Notice: Subject to any disclaimer, the term of this patent is extended or adjusted under 35 U.S.C. 154(b) by 515 days.

(21) Appl. No.: 11/661,840

(22) PCT Filed: Sep. 7, 2005

(86) PCT No.: PCT/US2005/032045

§ 371 (c)(1),
(2), (4) Date: Mar. 5, 2007

(87) PCT Pub. No.: WO2006/031613

PCT Pub. Date: Mar. 23, 2006

(65) Prior Publication Data

US 2008/0096625 A1 Apr. 24, 2008

Related U.S. Application Data

(60) Provisional application No. 60/608,683, filed on Sep. 10, 2004.

(51) Int. Cl.
*A63F 9/24* (2006.01)

(52) U.S. Cl. ..... 463/20; 463/16; 463/31

(58) Field of Classification Search ..... 463/16, 463/20, 21, 22, 25, 30, 31
See application file for complete search history.

(56) References Cited

U.S. PATENT DOCUMENTS

| | | | | |
|---|---|---|---|---|
| 5,580,053 | A | 12/1996 | Crouch | 463/20 |
| 5,611,535 | A | 3/1997 | Tiberio | 273/143 |
| 6,093,102 | A | 7/2000 | Bennett | 463/20 |
| 6,234,897 | B1 | 5/2001 | Frohm et al. | 263/20 |
| 6,261,178 | B1 | 7/2001 | Bennett | 263/20 |
| 6,604,999 | B2 | 8/2003 | Ainsworth | 463/20 |
| 6,869,360 | B2 | 3/2005 | Marks et al. | 463/25 |
| 6,966,835 | B2 | 11/2005 | Graham | 463/25 |
| 7,402,102 | B2 * | 7/2008 | Marks et al. | 463/20 |
| 2002/0055382 | A1 * | 5/2002 | Meyer | 463/20 |

(Continued)

OTHER PUBLICATIONS

International Search Report dated Jan. 21, 2006, PCT/US05/32045 (1 page).

*Primary Examiner*—James S. McClellan
(74) *Attorney, Agent, or Firm*—Nixon Peabody LLP

(57) ABSTRACT

The present invention is a method of conducting a wagering game having a plurality of symbol-bearing reels, comprising allowing a player to select one or more of a plurality of basic paylines (70) to define active paylines and, in response to the player meeting certain criteria, allowing a player to activate an enhanced payline (75). The method further includes randomly selecting a game outcome from a plurality of outcomes in response to a wager input, and displaying the game outcome as symbols aligned along the active paylines and the enhanced payline. Symbol combinations appearing along the active payline indicate awards according to a first paytable, while symbol combinations appearing along the enhanced payline (75) indicate awards according to a second paytable. The second paytable includes at least one winning symbol combination that is different from symbol combinations within the first paytable.

20 Claims, 9 Drawing Sheets

U.S. PATENT DOCUMENTS

2003/0060268 A1* 3/2003 Falconer ..... 463/20
2003/0064796 A1* 4/2003 Glavich et al. ..... 463/25
2003/0119579 A1* 6/2003 Walker et al. ..... 463/20
2003/0216165 A1 11/2003 Singer et al. ..... 463/20
2004/0140618 A1* 7/2004 Fox ..... 273/292
2004/0176159 A1* 9/2004 Walker et al. ..... 463/20
2004/0192431 A1* 9/2004 Singer et al. ..... 463/20
2006/0058099 A1* 3/2006 Soukup et al. ..... 463/25
2007/0026923 A1 2/2007 Muir ..... 463/16

* cited by examiner

WAGERING GAME WITH ENHANCED PAYLINE FEATURE

CROSS-REFERENCE TO RELATED APPLICATIONS

This application is a U.S. national phase of International Application No. PCT/US2005/032045, filed Sep. 7, 2005, which claims the benefit of priority of U.S. Provisional Patent Application No. 60/608,683, filed Sep. 10, 2004, both of which are incorporated by reference in their entirety.

FIELD OF THE INVENTION

The present invention relates generally to gaming terminals for playing a wagering game and, more particularly, to a wagering game having a unique feature for its paylines.

BACKGROUND OF THE INVENTION

Gaming terminals, such as slot machines, video poker machines, and the like, have been a cornerstone of the gaming industry for several years. Generally, the popularity of such terminals with players is dependent on the likelihood (or perceived likelihood) of winning money at the terminal and the intrinsic entertainment value of the terminal relative to other available gaming options. Where the available gaming options include a number of competing terminals and the expectation of winning each terminal is roughly the same (or believed to be the same), players are most likely to be attracted to the most entertaining and exciting of the terminals.

Consequently, shrewd operators strive to employ the most entertaining and exciting terminals available because such terminals attract frequent play and, hence, increase profitability to the operator. In the competitive gaming terminal industry, there is a continuing need for gaming terminal manufacturers to produce new types of games, or enhancements to existing games, which will attract frequent play by increasing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

In existing games with movable reels (i.e., a mechanical slot machine or a video slot machine), one or more paylines traverse the display region overlying the movable reels. The symbol combinations that are present along the paylines are used for indicating the outcome of the game. One advancement in this area has been the addition of more paylines, which are typically arranged in a straight and/or a zigzag configuration across the display region. While the inclusion of additional paylines on gaming terminals has created enhanced excitement for the player, there is an existing need to create additional player excitement by adding new features to the paylines. The present invention is directed to satisfying this and other needs.

SUMMARY OF THE INVENTION

The present invention generally relates to the use of an enhanced payline that is activated by the player when certain criteria have been met. For example, when the player has made a wager on all of the player-selectable basic paylines, the player may activate the enhanced payline. When the enhanced payline is activated, a paytable with different winning-symbol combinations can be used with respect to the enhanced payline. Thus, symbols or symbol combinations that have no value or little value with respect to the player-selectable basic paylines can have a high value if they are aligned along the enhanced payline. Consequently, when a typical low-value or no-value symbol passes through the player-selectable basic paylines, the player will feel enhanced excitement knowing that this low-value or no-value symbol may stop along the enhanced payline, yielding a winning outcome.

The present invention is a method of conducting a wagering game having a plurality of symbol-bearing reels, comprising allowing a player to select one or more of a plurality of basic paylines to define active paylines and, in response to the player meeting certain criteria, allowing a player to activate an enhanced payline. The method further includes randomly selecting a game outcome from a plurality of outcomes in response to a wager input, and displaying the game outcome as symbols in alignment along the active paylines and the enhanced payline. Symbol combinations appearing along the active payline indicate awards according to a first paytable, while symbol combinations appearing along the enhanced payline indicate awards according to a second paytable. The second paytable includes at least one winning symbol combination that is different from symbol combinations within the first paytable.

In another alternative, the present invention is a method of conducting a wagering game comprising allowing a player to select one or more of a plurality of basic paylines so as to define active paylines. In response to the player meeting certain criteria, the method includes allowing a player to activate an enhanced payline. The method further includes randomly selecting a game outcome from a plurality of outcomes, and displaying the game outcome by presenting a plurality of symbols to the player in a display region in which the active paylines and the enhanced payline are arranged. And, in response to a certain group of symbols appearing anywhere within the display region and the enhanced payline being active, the method includes transposing the certain group of symbols to the enhanced payline and awarding a corresponding award.

Other embodiments of the present invention include other methods to utilize the enhanced payline feature, as well as gaming terminals with display regions having the enhanced payline feature. As such, the above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
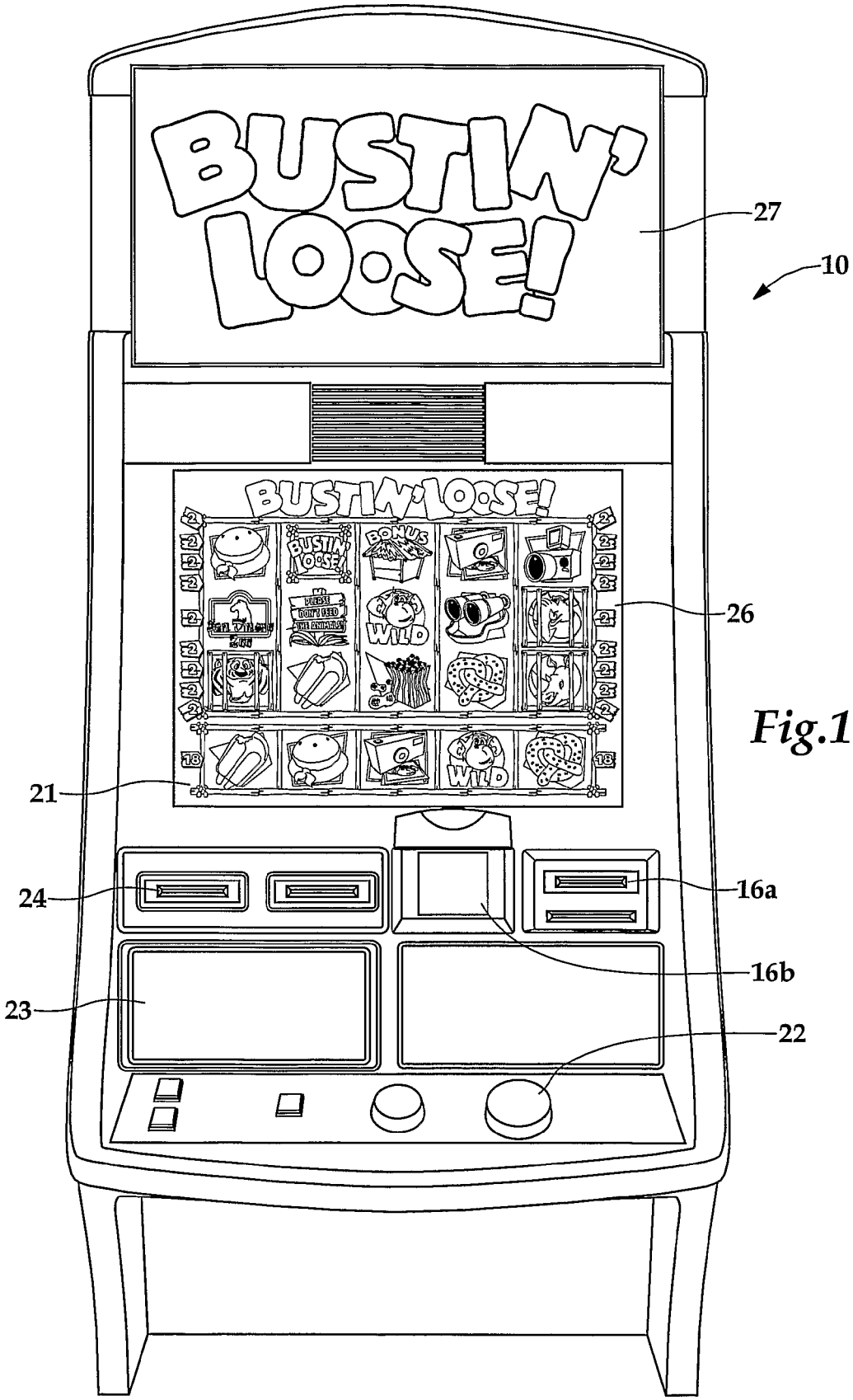
FIG. 1 illustrates a gaming terminal that has the enhanced payline feature in accordance with the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Referring to FIG. 1, a gaming terminal 10 is used in gaming establishments, such as casinos, to slot-machine wagering game. With regard to the present invention, the gaming terminal 10 may be any type of gaming terminal and may have varying structures and methods of operation.

The gaming terminal 10 includes input devices, such as a wager acceptor 16*a*, 16*b*, a touch screen 21, a push-button panel 22, and a player-identification card reader 24. For output, the gaming terminal 10 includes a main display 26 for displaying information about the basic wagering game. The main display 26 can also display information about a bonus wagering game and a progressive wagering game. The gaming terminal 10 also includes a secondary game display 27 for displaying the bonus wagering game, or for displaying award amounts of a progressive game. While these typical components found in the gaming terminal 10 are described below, it should be understood that numerous other elements may exist and may be used in any number of combinations to create various forms of a gaming terminal.

The wager acceptor 16*a*, 16*b* may be provided in many forms, individually or in combination. The wager acceptor 16*a*, 16*b* may include a coin slot acceptor 16*a* or a bill validator 16*b* to input value to the gaming terminal 10. Or, the wager acceptor 16*a*, 16*b* may include a card-reading device for reading a card that has a recorded monetary value with which it is associated. The card may also authorize access to a central account, which can transfer money to the gaming terminal 10.

A payout mechanism 23 performs the reverse functions of the wager acceptor 16. For example, the payout mechanism 23 may include a coin dispenser or a note dispenser to output value from the gaming terminal 10. Also, the payout mechanism 23 may also be adapted to receive a card that authorizes the gaming terminal 10 to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26. The main display 26 can also display the bonus game associated with the basic wagering game. The main display 26 may take the form of a cathode ray tube (CRT), a high resolution LCD, a plasma display, a LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10.

A player begins play of the basic wagering game by inserting a wager input into the wager input accepter 16*a*, 16*b* of the gaming terminal 10. A player can select play by either using the touch screen 21 or the push-button panel 22. The basic game consists of a plurality of symbols on a plurality of reels that are displayed along a plurality of paylines, yielding a plurality of outcomes of the basic game. Such outcomes are randomly selected and then displayed in response to the wagering input by the player.

Figure 2:
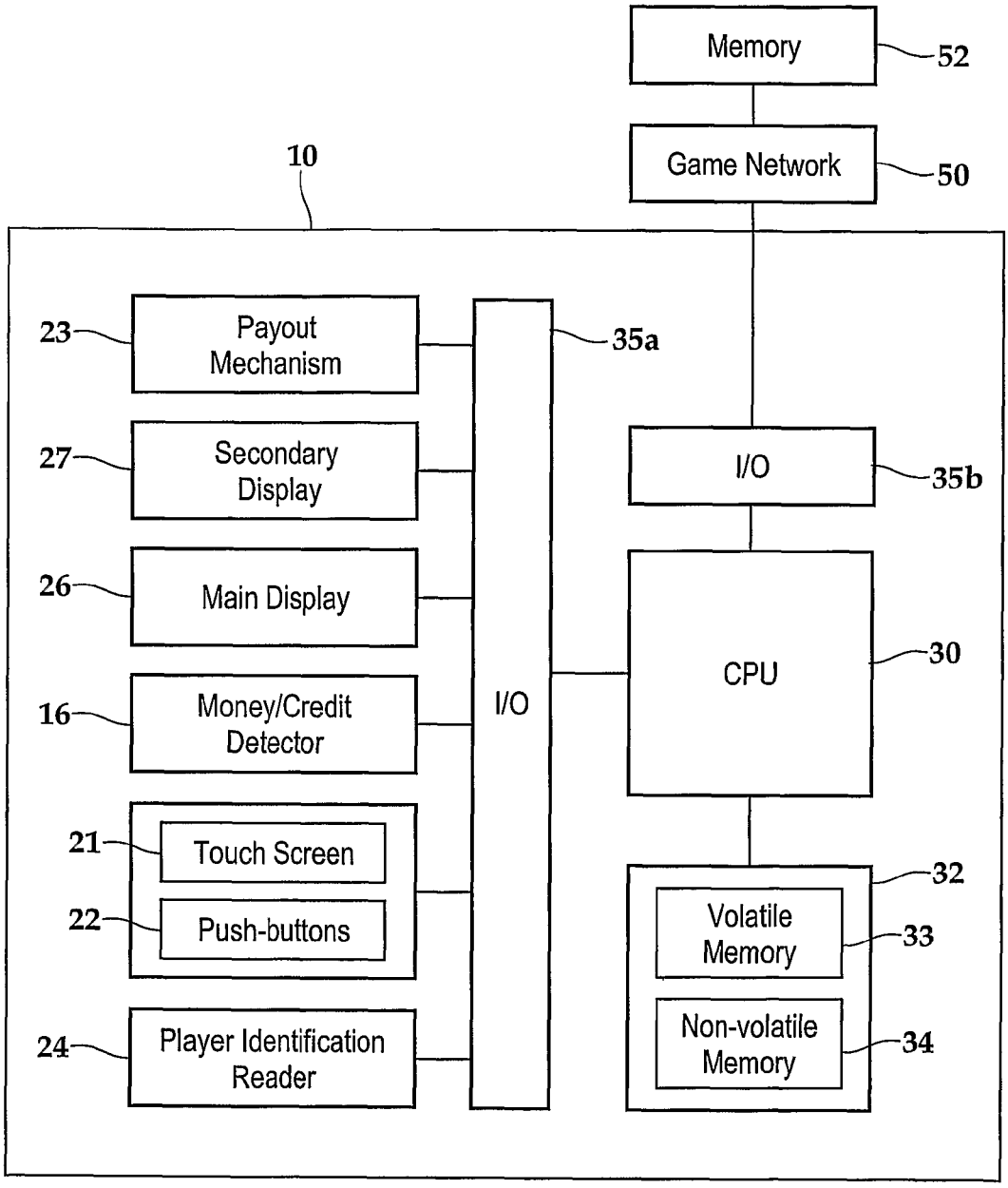
FIG. 2 illustrates a control system that is used in conjunction with the gaming terminal of FIG. 1.

As shown in FIG. 2, the various components of the gaming terminal 10 are controlled by a central processing unit (CPU) 30, also referred to as a processor (such as a microprocessor or microcontroller). To provide the gaming functions, the CPU 30 executes one or more game programs. The CPU 30 performs the random selection of an outcome from the plurality of outcomes of the wagering game. Alternatively, the random selection of an outcome may be performed remotely by a CPU that is networked to the gaming terminal 10 but is not a component of the gaming terminal 10. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and memory devices. The game control network 50 may optionally include a system memory 52 for alternative storage of data. The gaming terminal 10 often has multiple serial ports, each port dedicated to providing data to a specific host computer system that performs a specific function (e.g., accounting system, player-tracking system, progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

Figure 3A:
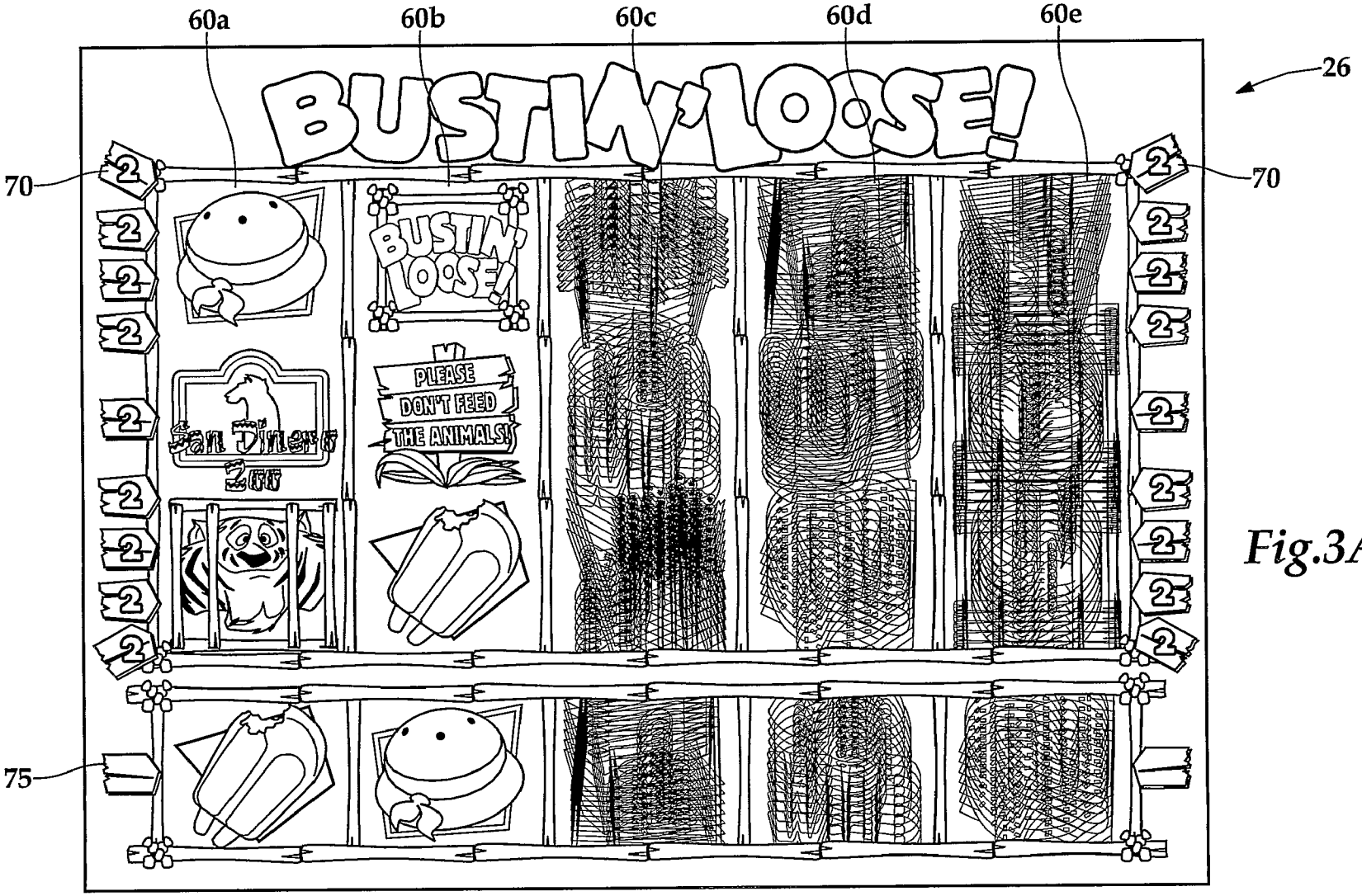
FIG. 3 illustrates the main display of the gaming terminal of FIG. 1 with the enhanced payline feature.
Figure 3B:
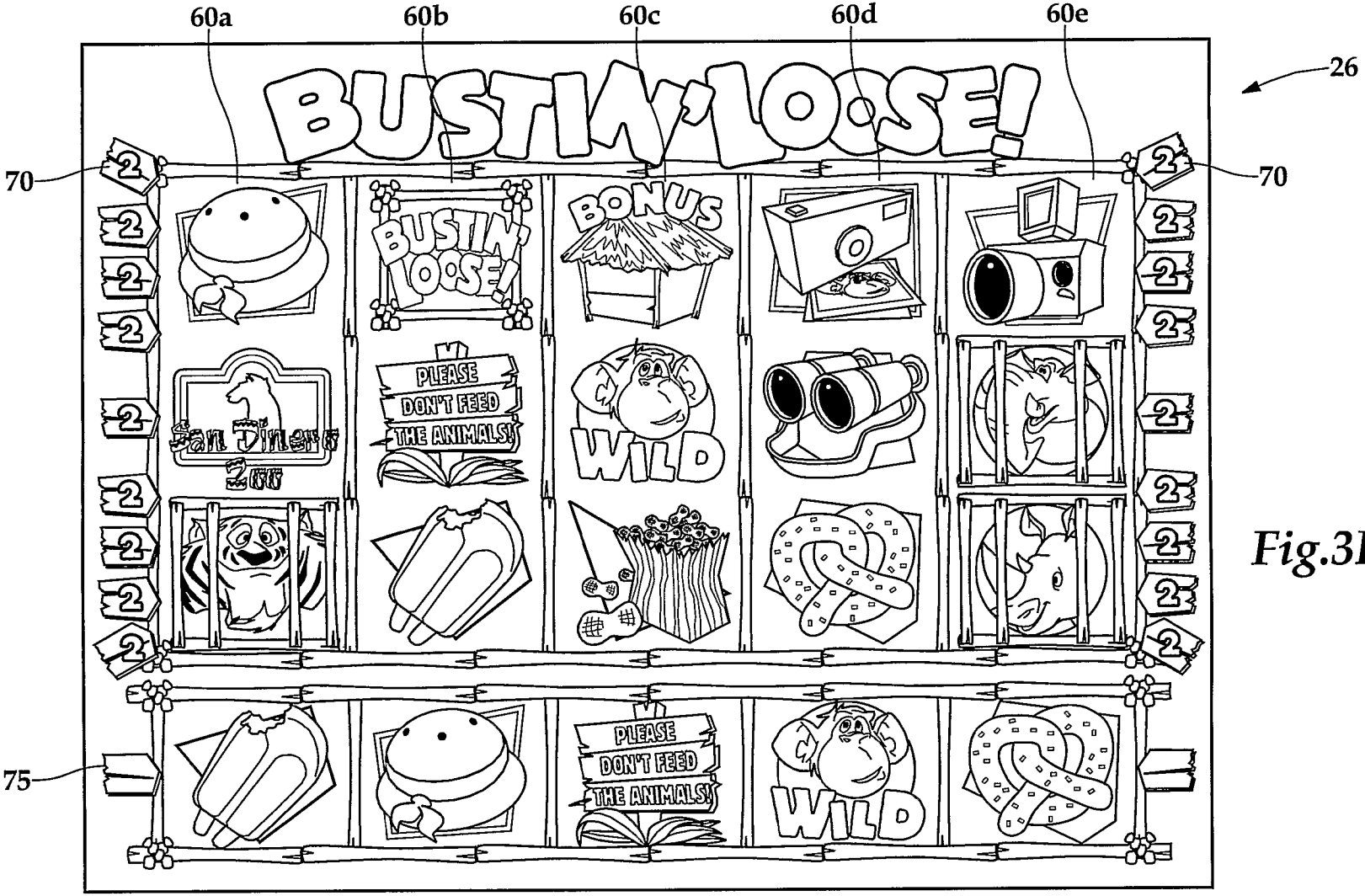

Referring now to FIGS. 3A and 3B, the main display 26 of the gaming terminal 10 includes five reels 60, which are shown as video reels. As shown in FIG. 3A, the motion on two of the reels 60*a* and 60*b* has stopped while the motion on the other three reels 60*c*, 60*d*, and 60*e* continues. As such, the gaming terminal 10 is in the process of displaying a randomly selected outcome in response to a wager input from the player. In FIG. 3B, all of the reels 60 have stopped and the symbols present on the reels 60 are used for indicating the randomly selected outcome.

The main display 26 also includes a plurality of basic paylines 70, each of which is selectable by the player. As shown, there are nine basic player-selectable paylines 70 that traverse the five reels 60. Symbols on the reels 60 that are aligned on each of the paylines 70 that have been selected (i.e., active paylines) will indicate an outcome for the player.

The paylines 70 may include a graphic that indicates the number of credits that the player has placed on each of the paylines 70, which is two credits as shown in FIGS. 3A and 3B. Accordingly, in FIGS. 3A and 3B, the player has selected all of the paylines 70 such that there are nine active paylines 70.

Additionally, the main display 26 illustrated in FIGS. 3A and 3B includes an enhanced payline 75. The player has the ability to activate the enhanced payline 75 in response to meeting certain criteria. For example, if the player has selected all of the basic paylines 70, then the enhanced payline 75 may automatically be activated. Alternatively, if the player has selected all of the basic paylines 70, then the enhanced payline 75 may be activated by the payment of an additional wager, for example, one credit. In other embodiments, the criteria may be that the player has wagered a certain amount within a certain time period, or a certain amount in the most recent spins of the reels 60. Yet further, the enhanced payline 75 may be activated in response to the identification of a player as a member of the casino's players club, which may be indicated by insertion of a player-tracking card into the gaming terminal 10.

Figure 4:
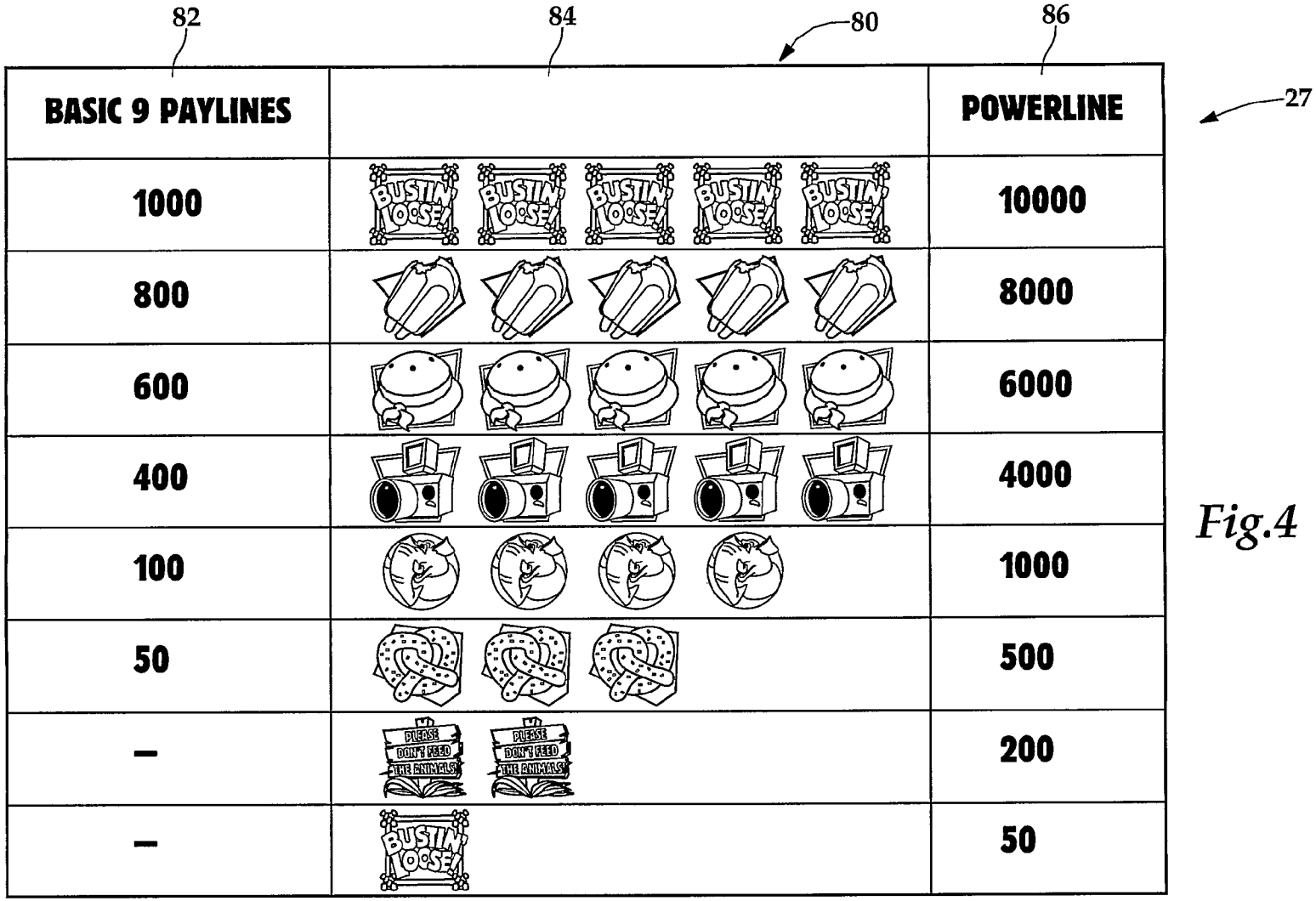
FIG. 4 illustrates a paytable for the gaming terminal of FIG. 1.

Once the enhanced payline 75 has been activated, the player is eligible for winning outcomes that are different from, and typically better than, the outcomes that can be achieved along the basic paylines 70. FIG. 4 illustrates an exemplary paytable 80, which can be displayed to the player on the secondary display 27 of the gaming terminal 10. As is typical for a paytable, the paytable 80 includes a first column 82 that shows the awards associated with the nine basic paylines 70 and a second column 84 that illustrates the symbol combinations that are required for those awards in the first column 82. Additionally, the paytable 80 includes a third column 86 that illustrates the awards that can be achieved when those symbol combinations in the second column 84 are aligned along the enhanced payline 75 (referred to in FIG. 4 as the "POWERLINE").

When comparing the awards in the first column 82 with the awards in the third column 86 of FIG. 4, two facts are noteworthy. First, there are symbol combinations (e.g., Two "please-don't-feed-the-animals" symbols, or one "Bustin'Loose" symbol) that, when aligned along the enhanced payline 75, indicates a winning outcome. However, when those same symbol combinations are aligned along one of the activated basic paylines 70, there are no awards. And second, for those symbol combinations in the second column 84 that have an award whether aligned along the basic paylines 70 or the enhanced payline 75, the award associated with the enhanced payline 75 is larger. Considering the differences associated with the awards for the enhanced payline 75 and the basic paylines 70, the wagering game includes a different set of game rules associated with the enhanced payline 75. Consequently, the paytable 80 is actually in illustration of a first paytable associated with the basic paylines 70, and a second paytable associated with the enhanced payline 75.

While the wagering game at the gaming terminal 10 uses the same symbols moving across the basic paylines 70 and the enhanced payline 75 when the enhanced payline 75 is activated as shown in FIG. 3A, the wagering game can also be designed so that different symbols or visually altered symbols are placed on the reels 60 in response to the enhanced payline 75 being activated. Yet further, one symbol on the reels 60 may have no effect when aligned on the basic payline 70, but may have a different effect when aligned on the enhanced payline 75 (e.g., the "safari hat" symbol in FIGS. 3A & 3B has its normal meaning when present on paylines 70, but is a "wild" symbol when aligned on the enhanced payline 75). In these alternative embodiments, the paytable 80 would further include these different symbols or altered symbols in the second column 84.

Figure 5:
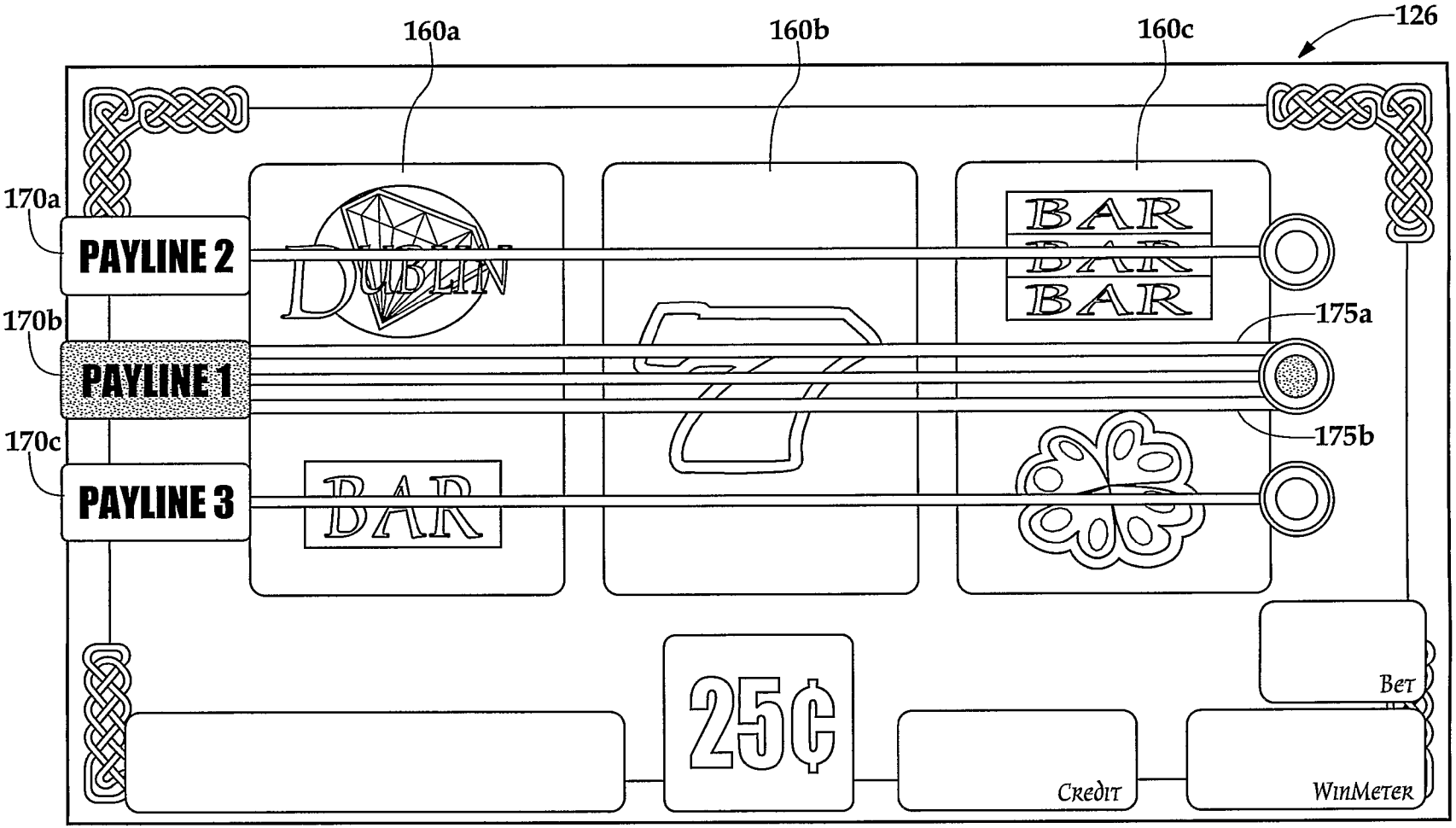
FIG. 5 illustrates a main display of another gaming terminal with an enhanced payline feature, according to an alternative embodiment of the present invention.

FIG. 5 illustrates a main display 126 of a gaming terminal that has a theme and game-play mechanic that is different from the gaming terminal 10 of FIGS. 1-4. Specifically, the main display 126 includes three reels 160, which are mechanical reels. Three basic paylines 170 traverse the three reels 160. The mechanical reels 160 and display region are constructed such that at least three vertically arranged symbols can be displayed to the player at one time once the motion of the reels 160 has stopped. Thus, the basic payline 170*a* corresponds to the uppermost vertically arranged symbol location on the reels 160. The basic payline 170*b* corresponds to the middle vertically arranged symbol location on the reels 160. And, the basic payline 170*c* corresponds to the lowermost vertically arranged symbol location on the reels 160.

In response to the player wagering three credits that places one credit along the basic payline 170*a*, one credit along the basic payline 170*b*, and one credit along the basic payline 170*c*, the player is eligible to activate one or two enhanced paylines 175. Specifically, if the player wagers a fourth credit, then the enhanced payline 175*a* is activated. Further, if the player wagers a fifth credit, then the enhanced payline 175*b* is activated. The enhanced paylines 175*a* and 175*b* traverse the three reels 160 in the same location as the basic payline 170*b* (i.e., the middle vertically arranged symbol location). When activated, the paylines 175*a* and 175*b* (and/or the circular or rectangular end markers at the proximate and distal ends of the enhanced paylines 175*a* and 175*b*) may be highlighted so that the player understands that he or she is now playing with the enhanced paylines 175 activated.

Figure 6:
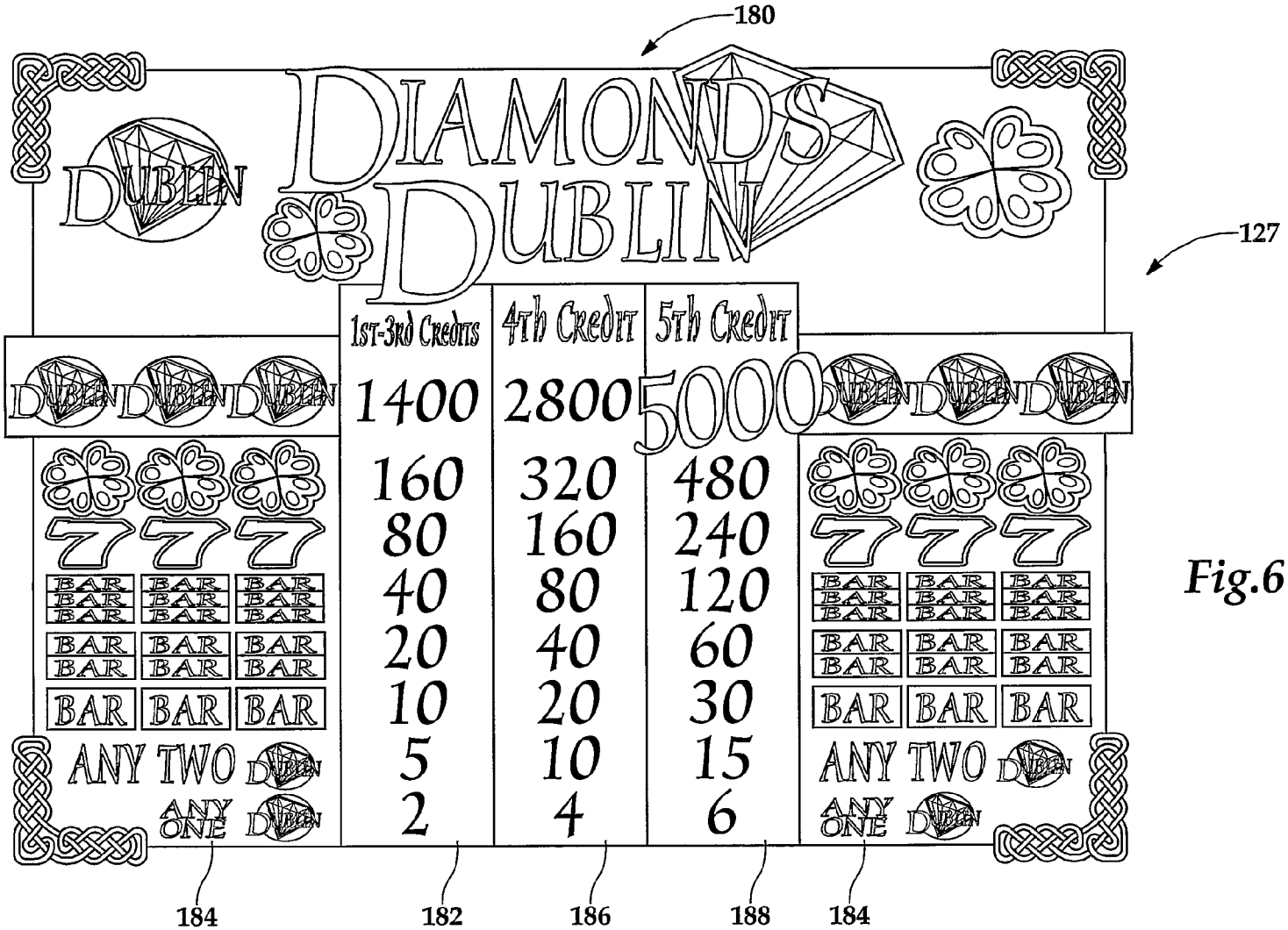
FIG. 6 illustrates a paytable used in conjunction with FIG. 5.

Like the embodiments discussed with respect to FIGS. 1-4, once the enhanced paylines 175 are activated, the player is eligible to receive enhanced awards if certain symbol combinations are aligned along the enhanced paylines 175. FIG. 6 illustrates a paytable 180 that corresponds to the symbol combinations that may be aligned along the basic paylines 170 or along the enhanced paylines 175. The paytable 180 may be displayed to the player on a secondary display 127, as shown, or it may be displayed to the player on art glass that is located on the gaming terminal. In particular, the paytable 180 is formatted with two identical columns 184 at the far left and far right of the paytable 180 that illustrate a plurality of winning symbol combinations. A first payout column 182 indicates the award if the corresponding symbol combination is achieved through alignment of that symbol combination along one of the activated paylines 170. A second payout column 184 indicates the award if the corresponding symbol combination is aligned along the enhanced payline 175*a*, assuming it was activated by the player by inputting a fourth credit wager. A third payout column 186 indicates the award if the corresponding symbol combination is aligned along the enhanced payline 175*b*, assuming it was activated by the player by inputting a fifth credit wager.

The payout structure of the wagering game in FIGS. 5 and 6 could be structured in various ways. Assuming that a player has placed five credits, thereby activating the enhanced payline 175*b*, and the player achieves the triple-diamond symbol combination (i.e., the highest award), the overall payout to the player would be 5000 credits in a first embodiment. In other words, the enhanced payline 175*b*, when activated, automatically deactivates the lower value enhanced payline 175 and the lower value basic payline 170*b*, both of which are commonly aligned along the middle vertically arranged symbol location. Alternatively, by activating the enhanced payline 175*b*, the player could win a cumulative award of 7800 credits for the triple-diamond symbol combination being aligned along the middle vertically arranged symbol location (i.e., only the basic payline 170*b* has been deactivated). Yet further, the player could win a cumulative award of 9200 credits for the triple-diamond symbol combination being aligned along the middle vertically arranged simple location, such that the basic payline 170*b*, the enhanced payline 175*a*, and the enhanced payline 175*b* remain activated once the player has wagered the fifth credit.

Figure 7:
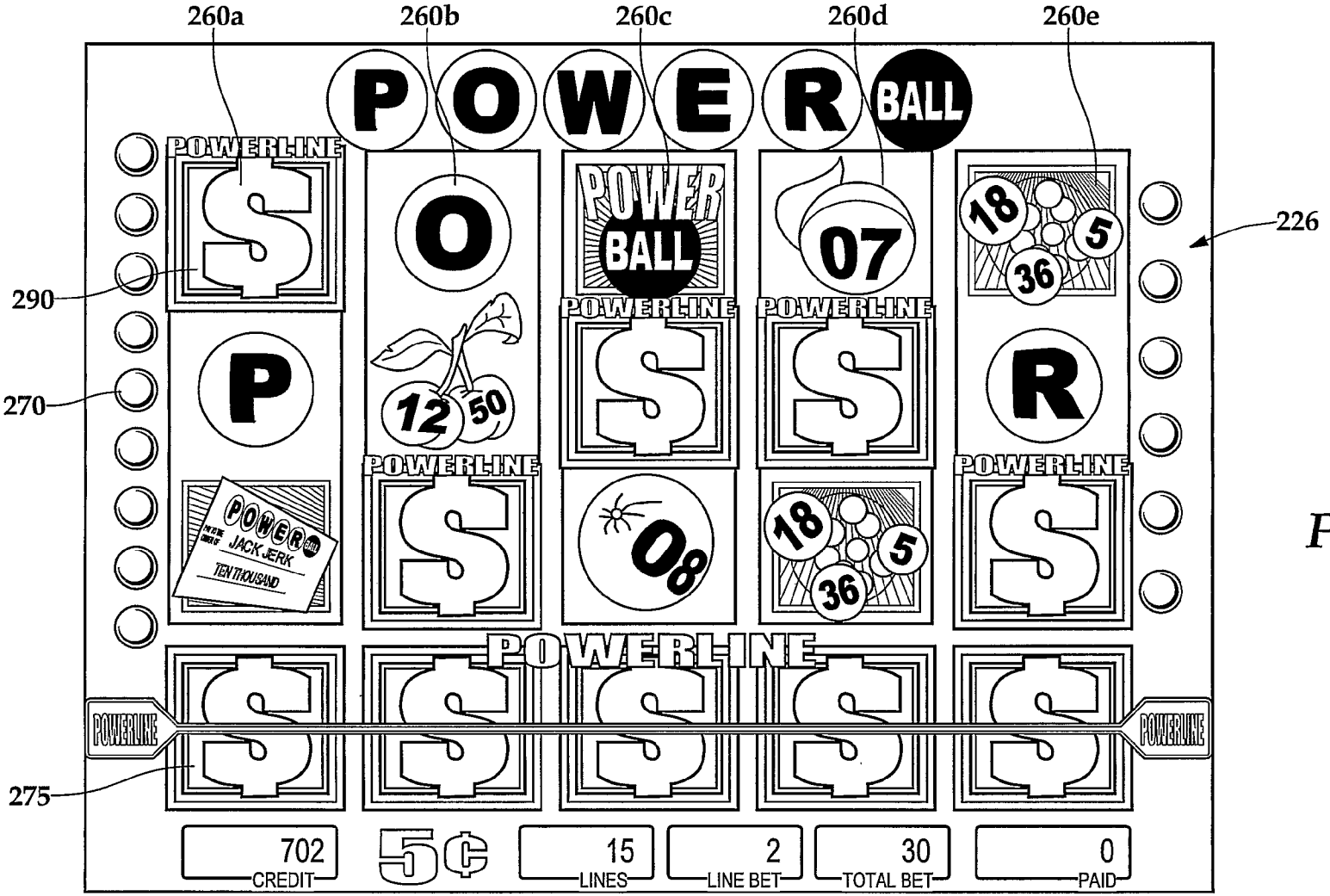
FIG. 7 illustrates a main display of yet another gaming terminal with an enhanced payline, according to an alternative embodiment of the present invention.

FIG. 7 illustrates an alternative embodiment of the enhanced payline feature on a main display 227 of another gaming terminal having a lottery theme. The gaming terminal of FIG. 7 is similar to the gaming terminal 10 of FIG. 1 in that the enhanced payline 275 is distinct and separated from the basic player-selectable paylines 270. The main difference between the embodiment of FIG. 7 and the previous embodiments is that the second paytable for the enhanced payline 275 also includes a "scatter" bonus or award whereby a "dollar" symbol 290 appearing anywhere in the display area for each of the five reels 260 causes the dollar symbol to be transposed to the enhanced payline 275, whereby a payout is awarded. In short, when the enhanced payline 275 has been activated, the gaming terminal may include a scatter bonus as part of the paytable associated with the enhanced payline 275.

Figure 8:
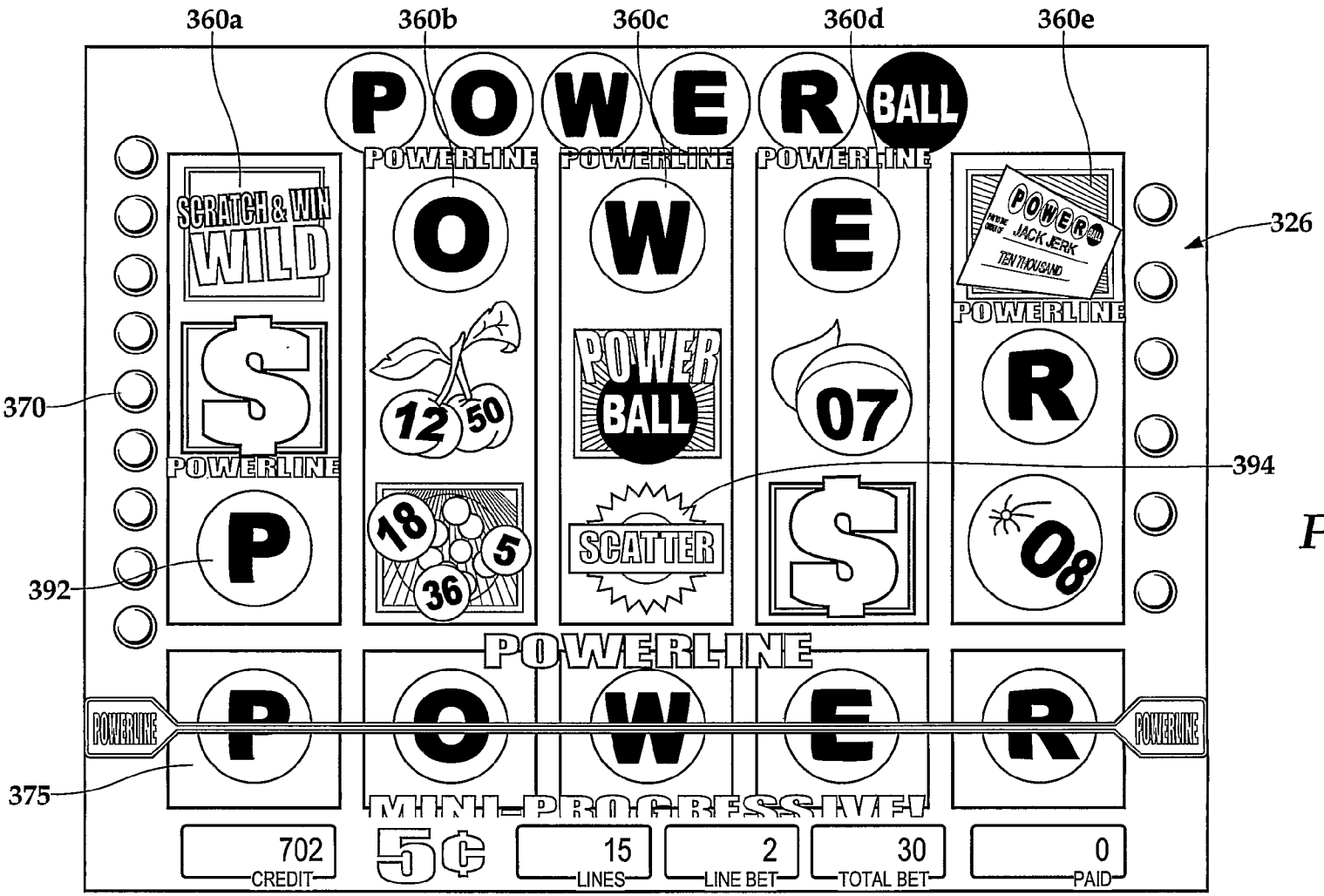
FIG. 8 illustrates a main display of a further gaming terminal with an enhanced payline that is similar to FIG. 7.

FIG. 8 illustrates another embodiment of the enhanced payline feature on a main display 327 of another gaming terminal having the lottery theme. Like FIG. 7, a scatter bonus or award may be awarded when the enhanced payline 375 is activated. However, in FIG. 8, in addition to the "POWER" word being spelled out as letter symbols 392 on the display area of the reels 360, the player must also obtain a "SCATTER" symbol 394 for the letter symbols 392 to be transposed to the enhanced payline 327.

Thus far, the symbol combinations have been described relative to winning an award in the basic wagering game. However, it should be noted that in any of the embodiments, the wagering game can be designed such that the player may obtain a certain type of bonus game, progressive game, or progressive award when the enhanced payline feature is activated. Further, the wagering game may be designed such that the player may only obtain a certain type of bonus game, progressive game, or progressive award when the enhanced payline feature is activated (i.e., these randomly selected outcomes are not available with respect to the same symbol combinations on the basic paylines). As one example, in FIG. 8, the "POWER" word spelled out on the enhanced payline 375 may yield one of a plurality of progressive awards for the wagering game. Further, such a progressive award may only be awarded when the player has placed a wager on all basic paylines 370, thereby activating the enhanced payline 375.

While the present invention has been described with reference to one or more particular embodiments, those skilled in the art will recognize that many changes may be made thereto without departing from the spirit and scope of the present invention. For example, more than one display device could be used to display the basic paylines and the enhanced payline. Each of these embodiments and obvious variations thereof is contemplated as falling within the spirit and scope of the claimed invention, which is set forth in the following claims.

What is claimed is:

1. A method of conducting a wagering game on a gaming terminal, comprising:

allowing a player to select one or more of a plurality of basic paylines in response to a first wager input, said selected one or more of said plurality of paylines being active paylines;

in response to the player placing said first wager input, allowing a player to activate an enhanced payline;

randomly selecting a game outcome from a plurality of outcomes using a controller associated with the gaming terminal; and presenting, on a display of the gaming terminal, a plurality of moveable reels having symbols thereon to said player, said symbols on each of said moveable reels sequentially moving across said plurality of basic paylines and said enhanced payline while said reel is moving, an alignment of said symbols along said active paylines and said enhanced payline indicating said game outcome, said plurality of symbols including a first set of symbol combinations and a second set of symbol combinations, said first set of symbol combinations indicating a winning outcome when aligned along said active paylines or said enhanced payline, said second set of symbol combinations indicating a winning outcome only when aligned along said enhanced payline, wherein said plurality of basic paylines are associated in a first pay table with a first set of winning game outcomes, and wherein said enhanced payline is associated with a second pay table with a second set of winning outcomes, said second set of winning outcomes comprising all of the winning outcomes in said first set of winning game outcomes and further comprising at least one additional winning outcome.

2. The method of claim 1, wherein said random selecting occurs in response to said first wager input.

3. The method of claim 1, wherein said allowing the player to activate said enhanced payline also requires the player to place a second wager input.

4. The method of claim 1, wherein said allowing the player to activate said enhanced payline only occurs in response to the player to selecting all of said plurality of basic paylines.

5. The method of claim 1, wherein said plurality of reels are mechanical reels.

6. The method of claim 1, wherein said plurality of reels are video reels.

7. The method of claim 1, wherein each of said plurality of basic paylines and said enhanced payline traverse each of said plurality of reels.

8. The method of claim 1, wherein said enhanced payline is distinct and separated from said plurality of basic paylines.

9. The method of claim 1, wherein said enhanced payline overlays one of said plurality of basic paylines.

10. The method of claim 1, wherein said presenting includes sequentially moving symbols included within said first and second sets of symbol combinations across each of said plurality of basic paylines and said enhanced payline.

11. The method of claim 10, wherein said second set of symbol combinations includes a symbol combination with only a single symbol.

12. A method of conducting a wagering game on a gaming terminal, comprising:

allowing a player to select one or more of a plurality of basic paylines in response to a first wager input, said selected one or more of said plurality of basic paylines being active paylines;

in response to the player selecting a certain number of said basic paylines, allowing a player to activate an enhanced payline;

randomly selecting a game outcome from a plurality of outcomes, using a controller associated with the gaming terminal, in response to a wager input; and presenting a plurality of symbols to said player on a display of the game terminal, said symbols being sequentially moveable across said plurality of basic paylines and said enhanced payline, an alignment of said symbols along said active paylines and said enhanced payline indicating said game outcome, said plurality of symbols including a first set of symbols that are alignable on said active paylines and said enhanced payline, symbols within said first set of symbols providing a winning outcome when aligned along said enhanced payline but not providing a winning outcome when aligned along said active paylines, wherein said plurality of basic paylines are associated in a first pay table with a first set of winning game outcomes, and wherein said enhanced payline is associated with a second pay table with a second set of winning outcomes, said second set of winning outcomes comprising all of the winning outcomes in said first set of winning game outcomes and further comprising at least one additional winning outcome.

13. The method of claim 12, wherein said allowing the player to select an enhanced payline for a second wager input only occurs in response to said player selecting all of said plurality of basic paylines.

14. The method of claim 12, wherein said first set of symbols includes only one symbol.

15. The method of claim 12, wherein said presenting includes sequentially moving said symbols across all of said basic paylines and said enhanced payline.

16. The method of claim 15, wherein said symbols are provided on a plurality of movable reels.

17. The method of claim 16, wherein each of said plurality of movable reels displays at least three symbols within a display region, said display region having said basic paylines and said enhanced payline that traverse said plurality of movable reels.

18. The method of claim 16, wherein said plurality of movable reels are mechanical reels.

19. The method of claim 12, wherein said enhanced payline is distinct and separated from said plurality of basic paylines.

20. A method of conducting a wagering game on a gaming terminal having a display comprising a plurality of symbol-bearing reels, comprising:

allowing a player to select one or more of a plurality of basic paylines, said selected one or more of said plurality of paylines being active paylines;

in response to the player meeting certain criteria, allowing a player to activate an enhanced payline;

randomly selecting a game outcome from a plurality of outcomes, using a controller associated with the gaming terminal in response to a wager input; and displaying, via the display of the gaming terminal, said game outcome as symbols on said plurality of symbol-bearing reels in alignment along said active paylines and said enhanced payline, said symbol-bearing reels being moveable across said plurality of basic paylines and said enhanced payline, symbol combinations appearing along said active paylines indicating awards according to a first paytable and symbol combinations appearing along said enhanced payline indicating awards according to a second paytable, said second paytable including all winning symbol combinations according to said first paytable and further comprising at least one winning symbol combination that is different from symbol combinations within said first paytable.

* * * * *